United States Patent [19]

Sastri et al.

[11] 4,180,420

[45] Dec. 25, 1979

[54] RAZOR BLADES

[75] Inventors: Suri A. Sastri, Stow; Ben H. Alexander, Weston, both of Mass.

[73] Assignee: The Gillette Company, Boston, Mass.

[21] Appl. No.: 856,732

[22] Filed: Dec. 1, 1977

[51] Int. Cl.[2] ..... C22C 38/22

[52] U.S. Cl. ..... 148/37; 75/126 C; 148/135; 148/156

[58] Field of Search ..... 75/126 C; 148/37, 12 E, 148/155, 156, 135

[56] References Cited

U.S. PATENT DOCUMENTS

| | | | |
|---|---|---|---|
| 3,116,180 | 12/1963 | Malzacher | 148/12.4 |
| 3,595,643 | 7/1971 | Boyce et al. | 75/126 C |
| 3,672,877 | 6/1972 | Carlen et al. | 75/126 C |
| 3,756,865 | 9/1973 | Sastri | 148/12 E |
| 3,826,697 | 7/1974 | Carlen et al. | 148/37 |
| 4,021,272 | 5/1977 | Asai et al. | 148/155 |

FOREIGN PATENT DOCUMENTS 1108377 3/1968 United Kingdom .

*Primary Examiner*—Arthur J. Steiner

*Attorney, Agent, or Firm*—Richard A. Wise; William M. Anderson

[57] ABSTRACT

The instant disclosure is concerned with martensitic stainless steel cutting edges such as razor blades which have superior corrosion resistance and which, although containing only between 0.30% to 0.45% carbon have hardnesses which are equal or better than cutting edges made from martensitic stainless steels containing 0.6% or more carbon which are widely sold commercially. Generally the blades are produced by treating them prior to hardening so that they will have a fine carbide microstructure comprising about 200 to about 500 carbides per 100 square microns, hardening them under conditions in which the fine microstructure will be substantially retained, i.e. subsequent to hardening they will still have about 200 to 500 carbides per 100 square microns, and forming the cutting edge.

2 Claims, No Drawings

RAZOR BLADES

In the past it has been generally thought that to obtain the optimum hardness in martensitic stainless steels for making cutting edges such as razor blades it was necessary that the steel contain at least 0.6% carbon. Exceptions were made in the martensitic steel used to make the ribbon-type razor blades disclosed in U.S. Pat. No. 3,595,643. In such ribbon-type blades it was essential to have superior corrosion resistance and flexibility and some hardness was sacrificed by using martensitic steels containing 0.30% to 0.45% carbon. In attempts to further enhance the corrosion resistance of such low carbon steels, carbide formers such as molybdenum and tungsten were also added. In the present invention it has been unexpectedly found that using such low carbon martensitic steels, i.e. containing 0.30% to 0.45% carbon, razor blades can be made which have hardnesses which are comparable or better than the hardnesses of widely sold martensitic stainless steel blades containing 0.6% or more carbon.

It has also been found that such hardnesses may be achieved without sacrificing much of the superior corrosion resistance. In fact even without carbide formers such as molybdenum or tungsten, the corrosion resistance of the low carbon martensitic stainless steel blades of this invention is superior to just about all types of stainless steel blades currently being sold (except of course the ribbon-type blades).

A further advantage of the present invention is that the low amounts of carbon make it easier to roll the steel to the desired thickness for making cutting edges such as razor blades and the like.

One object of the present invention is to provide low carbon martensitic stainless steel blades which have superior corrosion resistance and which have hardnesses which are comparable or better than martensitic stainless steel blades containing 0.6% or more carbon.

Another object of the present invention is to provide processes for producing such blades.

Other objects should be clear from the following detailed description taken together with the claims.

Generally the above objects are achieved by, prior to hardening, treating martensitic stainless steel cutting edge blanks, comprising 0.30% to 0.45% carbon, so that they will have fine carbide microstructures comprising between about 200 to 500 carbides per 100 square microns and then thereafter hardening them under conditions in which such fine carbide structure will be maintained. Usually, in such fine carbide structures the average diameters of the carbides will be generally less than 0.50 microns.

Methods for treating martensitic steels so that they will have such fine carbide structures are generally known. One such method is the isothermal annealing process disclosed in U.S. Pat. No. 4,021,272 which issued to Hitachi Metals Ltd. on May 3, 1977.

Generally the steels which are used to make the blades of the present invention comprise the following: 0.30% to 0.45% carbon and preferably 0.35% to 0.45% carbon; 11% to 16% chromium; 0 to 2.5% molybdenum; 0 to 4.0% tungsten; 0 to 0.70% silicon; 0 to 1.5% manganese, and the balance iron with incidental impurities. Although very small amounts of additional carbide formers such as vanadium, niobium, tantalum, titanium, and/or zirconium may be tolerated, the total amount of these metals generally should not exceed 2% by weight, preferably should generally not exceed 1.0% by weight and usually should be much less. Small quantities of such elements as cobalt, nickel, copper, aluminum, beryllium, and/or boron may also be tolerated but the total amount generally should not exceed 1%.

Generally when the steels contain a combination of molybdenum and tungsten as carbide formers the sum of the molybdenum plus ½ the tungsten should not exceed 2.5% by weight.

As pointed out above the hardnesses of the blades of the present invention are brought about by treating the steel in a manner such that prior to the hardening they will have a fine carbide microstructure comprising between about 200 to about 500 carbides per 100 square microns and hardening them under conditions in which such fine carbide microstructures will be maintained. In producing such fine carbide structures by the isothermal annealing processes such as set forth in U.S. Pat. No. 4,021,272 the steel is generally (a) heated to 550 to 750° for about 5 to 30 minutes; (b) subjected to a temperature in the range from immediately above the Acl point to the Acl point plus 50° C. for 5 to 30 minutes to make the steel austenitic; (c) held at a temperature within the range just below the Acl point to the Acl point minus 80° C. for at least 10 minutes to complete the isothermal transformation; (d) subjected to a temperature between 600° to 650° C. for about 5 to 10 minutes and (e) then cooled, e.g. by air or a combination of air and water quenching to room temperature.

In making razor blades according to the present invention, the steel, subsequent to the treatment for producing the fine carbide microstructure will generally be subjected to any of the desired stamping steps, hardened and then sharpened by any of the known sharpening methods. As pointed out above, the hardening step is carried out under conditions in which the fine carbide structure will be maintained, i.e. subsequent to hardening the steel will still have about 200 to about 500 carbides per 100 square microns. Generally the conditions under which the steel can be hardened and still retain the fine carbide structure are known to the art. In a preferred mode of carrying out the hardening step according to the processes of the present invention the steel is heated to a temperature between about 1000° to 1150° C., preferably to about 1075° to 1100° C. and held there for about 5 seconds to 60 seconds and then quenched to room temperature and preferably to a temperature between −20° C. to −120° C. and usually to a temperature between −40° C. to −80° C. As will be appreciated in the heating step, the larger times will be used for the lower temperatures and the shorter times will be used for the higher temperatures. If desired, the steel subsequent to quenching, may be annealed for a short time, e.g. 5 seconds to 60 seconds at a temperature between about 100° to 450° C.

Generally the steel blades of the present invention will have hardnesses within the range of 680 to 800 DPHN. Whereas, blades made from the same steel which are not subjected to the fine carbide treatment would have hardnesses between about 550 and 700 DPHN. The steel blades of the present invention are also generally at least as hard as those of the stainless steel blades which are widely sold today containing at least 0.6% carbon which have hardnesses between about 650 to 750 DPHN.

Generally subsequent to the forming of the cutting edge, the blades are coated with a shave enhancing polymer such as the silicones, polyethylenes, and polytetrafluoroethylenes. Usually when the polytetrafluoroethylene polymers are applied, it is necessary to subject the blades to temperatures of about 325° C. for about 10 to 15 minutes. Although such temperatures will soften the steels of the blades of this invention somewhat, their hardnesses will be at least comparable to those of the stainless steel blades widely sold today which have been subjected to the same heat treatment.

The following non-limiting example illustrates the processes of the present invention.

EXAMPLE I

A strip of steel which comprised 0.3% carbon, 0.37% silicon, 0.35% magnesium, 0.014% phosphorous, 0.006% sulfur, 13.66% chromium, 1.29% molybdenum, 0.06% nickel and the balance substantially iron and which had been rolled to a thickness of about 0.0039 inches for making razor blades, was subjected to an isothermal annealing process as set forth above so as to have a fine carbide structure comprising about 400 carbides per 100 square microns. The steel was then hardened by heating it to a temperature of 1125° C. for 12 seconds, and then quenching to −75° C. in methanol and dry ice. The steel was annealed at 150° C. for 7 seconds. Subsequent to the hardening and annealing steps, the steel had a hardness of about 770 DPHN. It was then sharpened by conventional methods and coated with a polytetrafluoroethylene telomer coating which was sintered at 350° C. for 10 minutes. Subsequent to the sintering step the blades had a hardness of about 600 DPHN. In a corrosion test the blades were far superior to commercial stainless steel blades comprising 0.6% carbon which (blades) had hardnesses of 740 DPHN after hardening and 600 DPHN after the sintering step. When the blades of this Example were shave tested they were longer lasting than commercial stainless steel blades containing at least 0.6% carbon and provided at least as good shaving performance.

EXAMPLE II

A strip of razor blade steel comprising 0.46% carbon, 0.20% silicon, 0.4% magnesium, 0.014% phosphorous, 0.003% sulfur, 13.83% chromium and the balance substantially iron was subjected to an isothermal annealing process as set forth above so as to have a microstructure comprising 250 carbides per 100 square microns. The steel was hardened by heating it to 1095° C. for 12 seconds and then quenching to −75° C. The steel was then annealed at 150° C. for 7 seconds. After the hardening and annealing steps the strip had a hardness of 770 DPHN. It was then sharpened by conventional methods and coated with a polytetrafluoroethylene telomer coating which was sintered at 350° C. for 10 minutes. After the sintering step the blades had a hardness of 640 DPHN. As with the blades of Example I the blades of this Example had far superior corrosion resistance, were longer lasting and provided at least as good shaving performance as commercial stainless steel blades containing at least 0.6% carbon.

Having thus described our invention, what is claimed is:

1. A martensitic stainless steel razor blade; said blade comprising 0.30% to 0.45% carbon; 11% to 16% chromium; 0 to 2.5% molybdenum; 0 to 4% tungsten; 0 to 0.70% silicon; 0 to 1.5% manganese, and the balance iron with incidental impurities and said blade having a fine carbide microstructure comprising about 200 to 500 carbides per 100 square microns.

2. A blade as defined in claim 1 in which the steel comprises about 0.35% to 0.45% carbon.

* * * * *